United States Patent [19]

Egan, Jr. et al.

[11] 4,170,109

[45] Oct. 9, 1979

[54] THRUST AUGMENTOR HAVING SWIRLED FLOWS FOR COMBUSTION STABILIZATION

[75] Inventors: William J. Egan, Jr., Lake Park; Kurt J. Hanloser, North Palm Beach; James H. Shadowen, Riviera Beach, all of Fla.

[73] Assignee: United Technologies Corporation, Hartford, Conn.

[21] Appl. No.: 849,905

[22] Filed: Nov. 9, 1977

[51] Int. Cl.[2] ..... F02K 3/10; F02K 3/06; F02K 1/02

[52] U.S. Cl. ..... 60/204; 60/261; 60/262; 60/39.71; 60/39.72 R; 60/39.82 P

[58] Field of Search ..... 60/261, 262, 39.72 R, 60/39.71, 39.82 P, 224, 204; 239/127.3, 265.17

[56] References Cited

U.S. PATENT DOCUMENTS

| | | | |
|---|---|---|---|
| 2,622,396 | 12/1952 | Clarke et al. | 60/39.71 |
| 2,673,445 | 3/1954 | Bruckmann | 60/261 |
| 2,697,910 | 12/1954 | Brzozowski | 60/39.82 P |
| 2,938,332 | 5/1960 | Boyd et al. | 60/224 |
| 3,368,352 | 2/1968 | Hewson | 60/262 |
| 3,528,250 | 9/1970 | Johnson | 60/261 |
| 3,540,216 | 11/1970 | Quillevere et al. | 60/261 |
| 3,677,012 | 7/1972 | Batscha | 60/262 |
| 3,747,345 | 7/1973 | Markowski | 60/39.72 R |

FOREIGN PATENT DOCUMENTS

| | | | |
|---|---|---|---|
| 1081277 | 5/1960 | Fed. Rep. of Germany | 60/262 |

*Primary Examiner*—John J. Vrablik
*Assistant Examiner*—Thomas I. Ross
*Attorney, Agent, or Firm*—Robert C. Walker

[57] ABSTRACT

A thrust augmentor for a turbofan, gas turbine engine is disclosed. Techniques for mixing and burning dissimilar density gases in a thrust augmentor are developed. In accordance with one specific teaching the flame front in a swirl augmentor is stabilized by a continuously operative pilot burner. The pilot burner is positioned in the radially outward portion of the augmentor.

10 Claims, 4 Drawing Figures

THRUST AUGMENTOR HAVING SWIRLED FLOWS FOR COMBUSTION STABILIZATION

BACKGROUND OF THE INVENTION

1. Field of the Invention

This invention relates to thrust augmentation in gas turbine engines, and more particularly to pilot stabilized combustion in a swirl augmentor.

2. Description of the Prior Art

Turbojet engines for aircraft use operatively produce a stream of gases exiting from the engine. The thrust generated by an engine is a function of the exhaust gas velocity and of the exhaust gas pressure. The higher the velocity and the higher the pressure of the exiting gases, the higher the corresponding thrust becomes. To obtain high velocities, fuel and high pressure air are burned in a combustion chamber within the engine. The high pressure air is supplied to the combustion chamber by a compressor upstream of the chamber. A predominant amount of the energy added to the medium gases in the combustion process is used to drive the compressor. The remaining portion of the added energy is convertible to engine thrust.

Early in the development of turbojet engines and in response to the military need for high performance aircraft, a second combustion station was added downstream of the turbine section to augment the thrust contribution of the main combustor. At the second combustion station the velocity of the gases is increased by adding additional energy to the gases. Combustion at the second station has become commonly known as "augmenting" or "afterburning," reburning of the gases originally burned in the main combustor.

Techniques employed in afterburners were at their inception, and remain today, quite distinct from those employed in main combustors. In particular, combustion concepts directed to the stabilization of a flame front at each respective combustion station differ widely. In main combustors the aerodynamic effects of locally swirling gases are employed to stabilize the flame front at the desired location. U.S. Pat. No. 2,676,460 to Brown entitled "Burner Construction of the Can-Annular Type Having Means For Distributing Airflow to Each Can" is representative of swirl stabilized main combustors. In augmentors, on the other hand, bluff body flameholders are disposed across the path of the medium gases to induce recirculation of gases behind the flameholders. Recirculation of the gases stabilizes and holds the flame front at the proximate location of the flameholder. U.S. Pat. No. 2,702,452 to Taylor entitled "Flameholder Construction" is representative of early concepts for flameholder stabilization in augmentors.

The augmentor of Taylor is directed to a turbojet type gas turbine engine. Since the early 1960's, however, gas turbine engines of prime importance have been those based upon the turbofan cycle. In a turbofan cycle engine a substantial portion of the air flowing through the engine is caused to bypass the main combustor. At the augmentor, therefore, the gas stream is comprised of a central core stream of relatively hot gases from the main combustor and a surrounding bypass stream of relatively cool gases. Before effective combustion of the combined streams can be affected, the cold air stream must be heated as through mixing with the hot core gases. One widely accepted technique for mixing the gases is to shape the afterburner flameholder such that it causes hot gases of the core to be directed outwardly into the cold air stream. U.S. Pat. No. 3,295,325 to Nelson entitled "Jet Engine Afterburner Flameholder" illustrates such a shaped flameholder and describes its operation.

Very recent advances in combustor and augmentor technology are disclosed in U.S. Pat. No. 3,788,065 to Markowski entitled "Annular Combustion Chamber For Dissimilar Fluids in Swirling Flow Relationship" and in U.S. Pat. No. 3,747,345 to Markowski entitled "Shortened Afterburner Construction For Turbine Engine" which adapts the concepts of the U.S. Pat. No. 3,788,065 to augmentor embodiments. The concepts disclosed in these Markowski patents are now known in the industry as "swirl burning." Note in the U.S. Pat. No. 3,747,345 that, even with these most recent combustion techniques, the flame stabilization concepts of prior turbojet and turbofan augmentors are utilized.

Scientists and engineers in the gas turbine field are continuing to search for new stabilization concepts and techniques, and particularly those which can adapt swirl burning techniques to effective embodiments.

SUMMARY OF THE INVENTION

A primary object of the present invention is to provide a thrust augmentor capable of reliable and stable operation over a wide range of engine operating conditions. The employment of swirl burning principles in the augmentor is one particular aim, and effective means for stabilizing the flame front in such an augmentor is sought.

According to the present invention, a continuously operative pilot burner positioned in the radially outward region of a thrust augmentor ignites and stabilizes the combustion of differing density gases in a strongly swirling flow field.

A primary feature of the present invention is the swirl augmentor. An inner row of vanes in the core duct and an outer row of vanes in the bypass duct are adapted to establish two concentric swirling flows. In at least one embodiment the inner and outer vanes are rotatable so as to vary the amount of swirl imparted to the gases flowing thereacross. Another feature is the pilot burner positioned radially outward of the concentric flows. A flow divider separates the pilot burner from the concentric swirling flows. Means for supplying fuel to the augmentor is positioned inwardly of the flow divider. The pilot burner is of the annular type and, in one embodiment, includes a plurality of circumferentially spaced fuel nozzles at the upstream end thereof. In one embodiment augmentor fuel is preheated in the flow divider prior to discharge into the bypass stream. In another embodiment, hot gases from the engine core are ducted to the pilot burner to aid in the vaporization of fuel in the pilot burner.

A principal advantage of augmentor apparatus incorporating the concepts of the present invention is reduced susceptibility to lean blowouts. In the apparatus disclosed, the blowout limit of the augmentor is defined by the lean flammability limit of the pilot burner alone. Another advantage is reduced drag losses in the augmentor as enabled through the elimination of a mechanical flameholder in the main flow of the augmentor. The pilot burner positions and stabilizes the flame front within the augmentor. The need for a structural flameholder is eliminated.

The foregoing and other objects, features and advantages of the present invention will become more apparent in the light of the following detailed description of the preferred embodiment thereof as shown in the accompanying drawing.

DESCRIPTION OF THE PREFERRED EMBODIMENT

Figure 1:
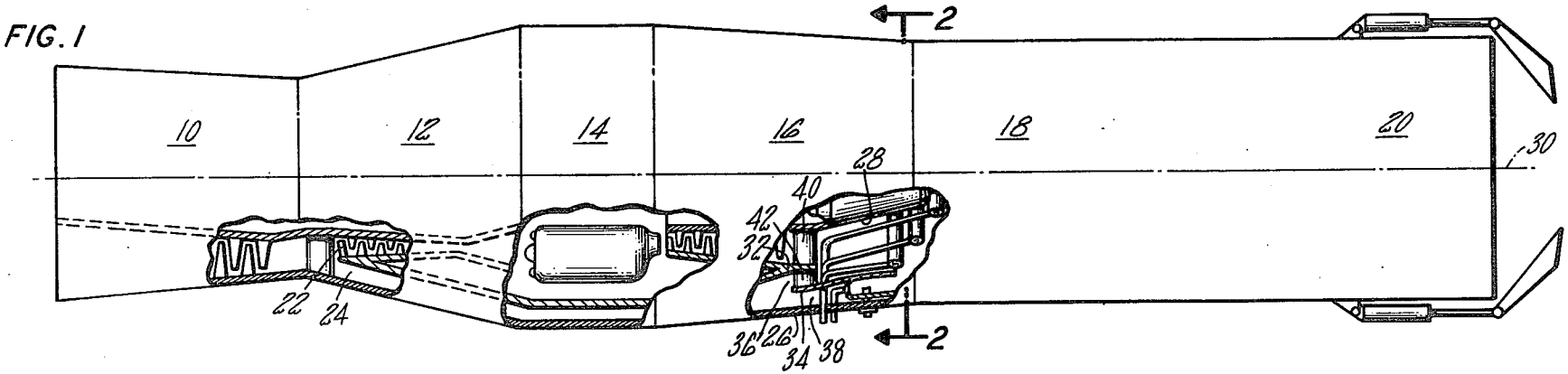
FIG. 1 is a simplified, partial cross section illustration of a turbofan, gas turbine engine showing detailed components of the thrust augmentor.

An augmented turbofan engine is illustrated in FIG. 1. The engine principally includes a fan section 10, a compressor section 12, a main combustor section 14, a turbine section 16, a thrust augmentor section 18 and an exhaust nozzle section 20. A core duct 22 carries to the compressor section a portion of the working medium gases discharged from the fan section. These gases are subsequently flowed through the main combustor section and through the turbine section to the augmentor section of the engine. The gases flowing through the core duct are hereinafter referred to as "core gases." A bypass duct 24 carries the remaining portion of the working medium gases discharged from the fan section, around the compressor, main combustor, and turbine sections to the augmentor section. The gases flowing through the bypass duct are hereinafter referred to as "bypass gases."

The thrust augmentor section is enclosed within a casing 26. A tailcone 28 is centered about the engine axis 30. An intermediate casing 32 separates the core gases entering the augmentor and the bypass gases entering the augmentor into two concentric streams. A flow divider 34 is spaced radially between the intermediate casing and the augmentor casing to divide the bypass gases into an inner stream 36 and an outer stream 38.

A plurality of core vanes 40 is disposed across the core gases between the tailcone and the intermediate casing. A plurality of bypass vanes 42 is disposed across the inner stream of the bypass gases between the intermediate casing and the flow divider. Both the core vanes and the bypass vanes are adapted to swirl the flow passing thereacross circumferentially about the engine and in the same direction. A plurality of circumferentially extending spray rings 44 is disposed across the augmentor downstream of the core vanes and the bypass vanes. Fuel supply means 46 direct the main augmentor fuel to the spray rings.

Figure 2:
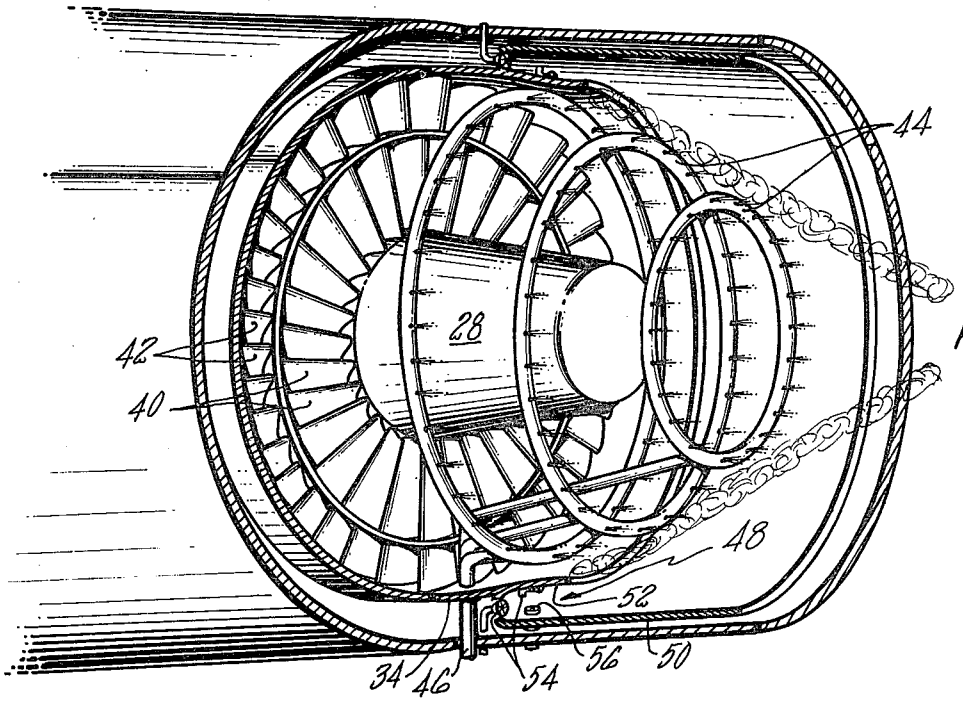
FIG. 2 is a simplified, partial perspective view of the augmentor illustrated in FIG. 1.

A pilot burner 48 is positioned radially outward of the flow divider. The pilot burner of at least one embodiment, as shown in greater detail in FIG. 2, is an annular burner having an essentially cylindrical outer liner 50 which is concentric with the augmentor casing 26, and having an inner liner 52 which may be a downstream extension of the flow divider 34. Fuel injection means, such as the fuel nozzles 54, are disposed at the upstream end of the pilot burner. In embodiments employing fuel nozzles, a plurality of the nozzles are spaced circumferentially about the burner. An igniter 56 penetrates the outer liner 50 at a location downstream of the fuel injection means.

The pilot burner is adapted for continuous burning during all conditions of augmentor operation. Fuel from the injection means 54 is mixed with air from the outer stream 38 of the bypass flow. The fuel/air mixture is ignited by the igniter 56 and burned within the pilot burner to produce a high temperature, low density effluent from the pilot burner. Upon discharge the effluent flows in an annular band along the outer liner 50. The temperature of the effluent gases is on the order of thirty-six hundred degrees Rankine (3600° R) and the density is approximately twenty-seven thousandths of a pound per cubic foot (0.027 lb/ft$^3$).

As is illustrated in FIG. 2, the core vanes 40 and the bypass vanes 42 are adapted to swirl the respective streams flowing thereacross in a circumferential direction about the axis of the engine. A swirl angle of discharge from the vanes on the order of twenty to thirty-five degrees (20°–35°) during augmentor operation is desired such that a strongly swirling flow field is established. The density of the core gases in the swirling field at sea level takeoff condition is approximately sixty-seven thousandths of a pound per cubic foot (0.067 lb/ft$^3$) and the density of the bypass gases at sea level takeoff condition in the swirling field is approximately one hundred sixty-seven thousandths of a pound per cubic foot (0.167 lb/ft$^3$).

Fuel is injected into both the inner stream 36 of the bypass gases and the core gases by the spray rings 44. The fuel becomes mixed with the core and bypass gases and is swirled therewith.

One of the major attributes of the augmentor of the present invention is the ability of the apparatus to cause mixing of the bypass and core streams. Directing the core and bypass streams across the core vanes and bypass vanes respectively induces a strongly swirling flow field. The bypass gases are centrifuged radially outward in the swirling flow field thereby displacing the hot pilot gases discharged by the pilot burner. The bypass gases become ignited by the pilot burner and a flame front is established. The flame front progresses radially inward toward the axis of the engine in a conical pattern as illustrated in FIG. 2. As soon as the flame front penetrates the path of the bypass gases, the core gases become the relatively more dense medium and the core gases in turn become centrifuged outwardly thereby displacing the combined pilot and bypass gas streams. Complete mixing and burning of both the core and bypass streams without the need of mechanical flameholders or mixers results.

The pilot burner is operative over the entire range of augmentor conditions and serves to position, hold and stabilize the augmentor flame front downstream of the spray rings 44. The pilot burning concepts are particularly advantageous in preventing lean blowout of the augmentor such as occurs in more conventional augmentors under low fuel flow conditions. In effect, the lean blowout point becomes the lean flammability limit of the pilot. As long as the pilot is operating the mainstream augmentor flow can be ignited and stabilized.

Figure 3:
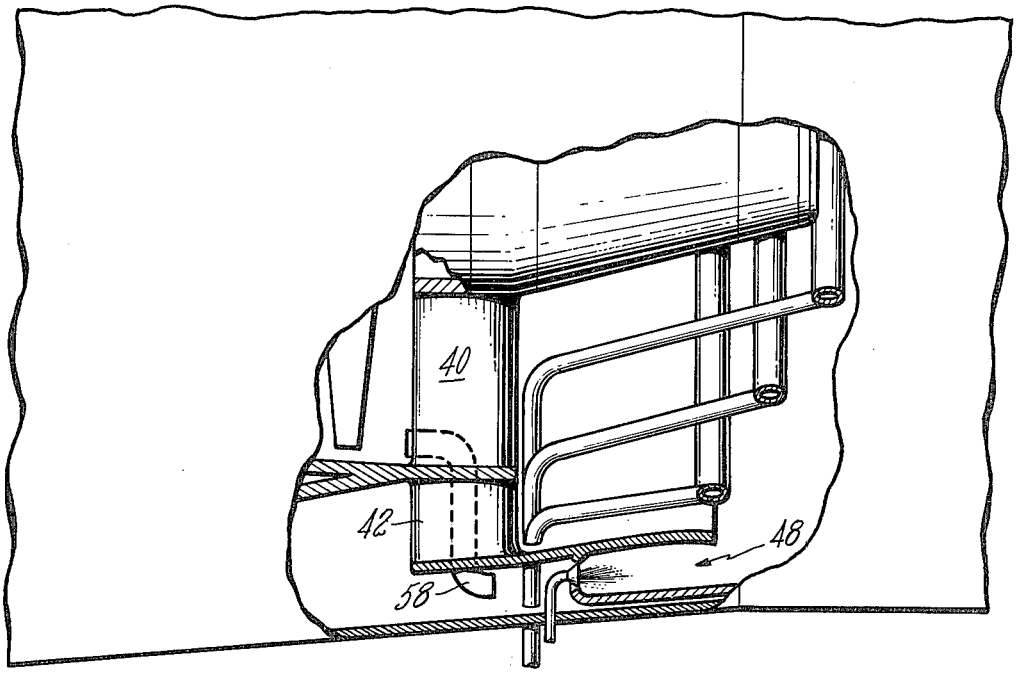
FIG. 3 is a simplified cross section view showing a more detailed embodiment of the augmentor.

In the FIG. 3 embodiment of the invention, core gases are ducted to the inlet of the pilot burner 48 through suitable conduit means 58. As shown the hot core gases are ducted through the interior of the bypass vanes 42. Injection of hot core gases into the pilot burner raises the temperature therein and increases the vaporization rate of the pilot fuel.

Figure 4:
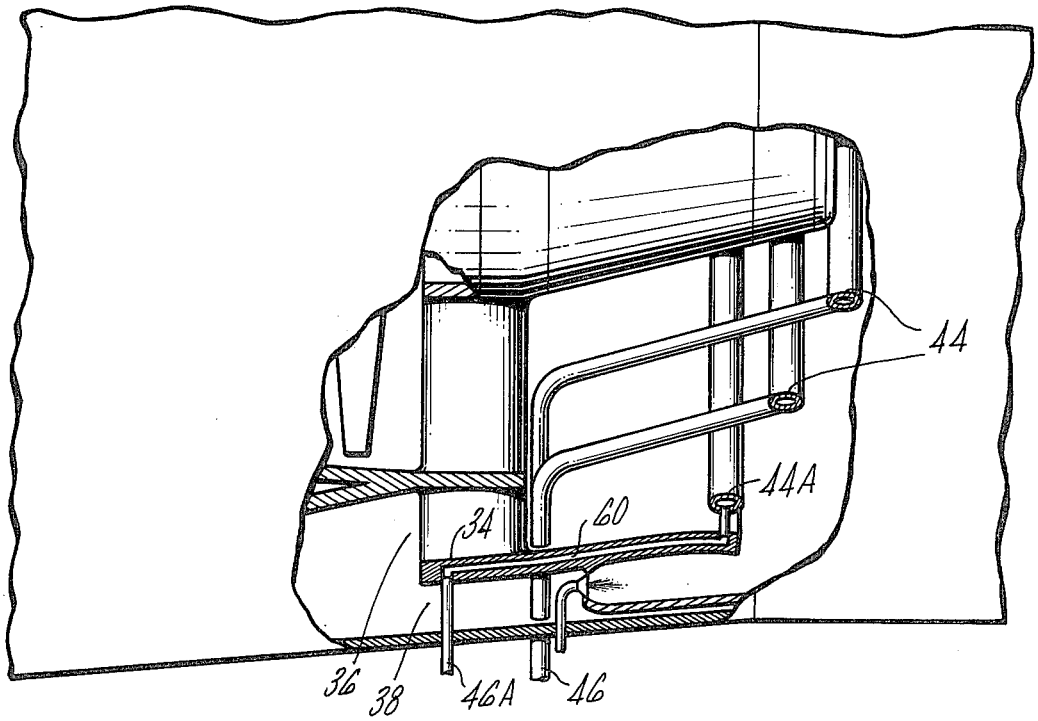
FIG. 4 is a simplified cross section view showing another more detailed embodiment of the augmentor.

In the FIG. 4 embodiment of the invention, the fuel supply means 46A includes a heat exchanger 60 in proximity or formed within the flow divider 34. The temperature of the main augmentor fuel to the inner stream 36 of the bypass gases is increased in the flow divider as the fuel flows therethrough. The increased temperature fuel has an expanded potential for vaporization at discharge from the spray rings 44A.

Although the invention has been shown and described with respect to preferred embodiments thereof, it should be understood by those skilled in the art that various changes and omissions in the form and detail thereof may be made therein without departing from the spirit and the scope of the invention.

Having thus described typical embodiments of our invention, that which we claim as new and desire to secure by Letters Patent of the United States is:

1. An augmentor structure of the type adapted for use with a gas turbine engine having a core stream and a bypass stream of relatively high density working medium gases wherein said augmentor includes:

an annular pilot burner circumscribing said bypass stream and adapted to produce during operation an annular stream of relatively low density working medium gases;

means for injecting fuel into said core and bypass stream; and means for inducing swirl in said core and bypass streams such that the medium gases of the core and bypass streams are centrifuged radially outward into said medium gases emanating from the pilot burner.

2. For a turbofan engine of the type adapted to produce a core stream and a bypass stream of working medium gases, a thrust augmentor comprising:

an augmentor casing;

a tailcone positioned internally of said augmentor casing;

an intermediate casing disposed radially between said tailcone and said augmentor casing, and separating the core stream of working medium gases from the bypass stream of working medium gases;

a circumferentially extending flow divider spaced radially between said intermediate casing and said augmentor casing, and which is adapted to separate the bypass stream into a radially inner stream and a radially outer stream;

a plurality of circumferentially spaced core vanes extending between said intermediate casing and said tailcone;

a plurality of circumferentially spaced bypass vanes extending radially between said flow divider and said intermediate casing;

main fuel supply means spaced axially downstream of said core and bypass vanes; and an annular pilot burner disposed across the path of said outer stream between said flow divider and said casing wherein said pilot burner is adapted to produce an annular stream of high temperature, relatively low density effluent, wherein said bypass and core vanes are adapted to impel the gases flowing thereacross radially outward into the effluent from said pilot burner.

3. The invention according to claim 2 wherein said core vanes and said bypass vanes are adapted to direct flow thereacross at a swirl angle of twenty to thirty-five degrees (20°–35°) during augmentor operation.

4. The invention according to claim 2 wherein said pilot burner includes at the upstream end thereof a plurality of fuel nozzles for discharging pilot fuel to said burner.

5. The invention according to claim 4 which further includes means for flowing core gases to the pilot burner to increase the vaporization rate of fuel within the pilot burner.

6. The invention according to claim 5 wherein at least a portion of said means for flowing core gases is embedded in said bypass vanes.

7. The invention according to claim 2 wherein said main fuel supply means includes at least one spray ring disposed across the stream of bypass gases downstream of the bypass vanes.

8. The invention according to claim 7 which further includes means for flowing fuel to said spray ring.

9. The invention according to claim 8 wherein said fuel supply means includes a heat exchanger for raising the temperature of the fuel supplied to said spray ring.

10. A method for augmenting the thrust of a turbofan, gas turbine engine comprising the steps of:

forming a core stream of working medium gases from the turbine section of the engine;

forming an annular bypass stream of working medium gases from the fan section of the engine around said core stream;

flowing a radially outward portion of said bypass stream through an annular pilot burner to produce an annular stream of hot, low density effluent circumscribing the remaining bypass stream and the core stream;

swirling said working medium gases of the remaining bypass stream and of the core stream circumferentially about the engine to centrifuge these gases radially outward into the hot, low density gases of the pilot burner effluent; and discharging fuel into said swirling working medium gases such that a mixture of fuel and air is centrifuged into the hot, low density gases of the pilot burner effluent and is ignited thereby.

* * * * *